US008251750B2

(12) United States Patent
Sun

(10) Patent No.: US 8,251,750 B2
(45) Date of Patent: Aug. 28, 2012

(54) ADAPTER APPARATUS

(75) Inventor: Zheng-Heng Sun, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/050,959

(22) Filed: Mar. 18, 2011

(65) Prior Publication Data

US 2012/0164852 A1 Jun. 28, 2012

(30) Foreign Application Priority Data

Dec. 28, 2010 (CN) ..... 2010 1 0609757

(51) Int. Cl.
*H01R 31/06* (2006.01)

(52) U.S. Cl. ..... 439/638; 439/76.1; 439/660

(58) Field of Classification Search ..... 439/638, 439/76.1, 660
See application file for complete search history.

(56) References Cited

U.S. PATENT DOCUMENTS

| | | | | | |
|---|---|---|---|---|---|
| 4,618,196 | A * | 10/1986 | Muzslay | 439/492 |
| 5,502,892 | A * | 4/1996 | Lien | 29/841 |
| 5,900,512 | A * | 5/1999 | Elnagar et al. | 568/14 |
| 6,364,713 | B1 * | 4/2002 | Kuo | 439/638 |
| 6,527,188 | B1 * | 3/2003 | Shobara et al. | 235/486 |
| 6,736,678 | B2 * | 5/2004 | Yao | 439/638 |
| 7,244,126 | B2 * | 7/2007 | Morana et al. | 439/76.1 |
| 7,497,738 | B2 * | 3/2009 | Kuo | 439/638 |
| 7,661,983 | B2 * | 2/2010 | Yang et al. | 439/490 |
| 7,762,845 | B1 * | 7/2010 | Huang et al. | 439/607.22 |
| 7,887,337 | B1 * | 2/2011 | Yuan et al. | 439/76.1 |
| 7,946,857 | B2 * | 5/2011 | Wang | 439/76.1 |
| 7,997,909 | B2 * | 8/2011 | Xu et al. | 439/76.1 |
| 2005/0026469 | A1 * | 2/2005 | Ice et al. | 439/76.1 |
| 2006/0094267 | A1 * | 5/2006 | Li | 439/76.1 |
| 2007/0032104 | A1 * | 2/2007 | Yamada et al. | 439/76.1 |
| 2007/0275577 | A1 * | 11/2007 | Masumori | 439/76.1 |

* cited by examiner

*Primary Examiner* — Gary F. Paumen
(74) *Attorney, Agent, or Firm* — Altis Law Group, Inc.

(57) ABSTRACT

An adapter apparatus for connecting two connectors of the same type includes a receiving rack used to fasten two connectors, and a connection board attached to the receiving rack. A number of first gold fingers and a number of second gold fingers are formed on opposite ends of the connection board, to be electrically connected to the connectors, respectively.

9 Claims, 6 Drawing Sheets

ADAPTER APPARATUS

BACKGROUND

1. Technical Field

The present disclosure relates to adapter apparatuses, particularly to an adapter apparatus for serial advanced technology attachment (SATA) connectors.

2. Description of Related Art

With advances in the computer technology, SATA connectors are more and more popularly used in disk drives and other storage peripherals. There are two types of SATA connectors: male connectors and female connectors, the male connectors are engaged with the female connectors. However, a female connector cannot engage with another female connector, and a male connector cannot engage with another male connector.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
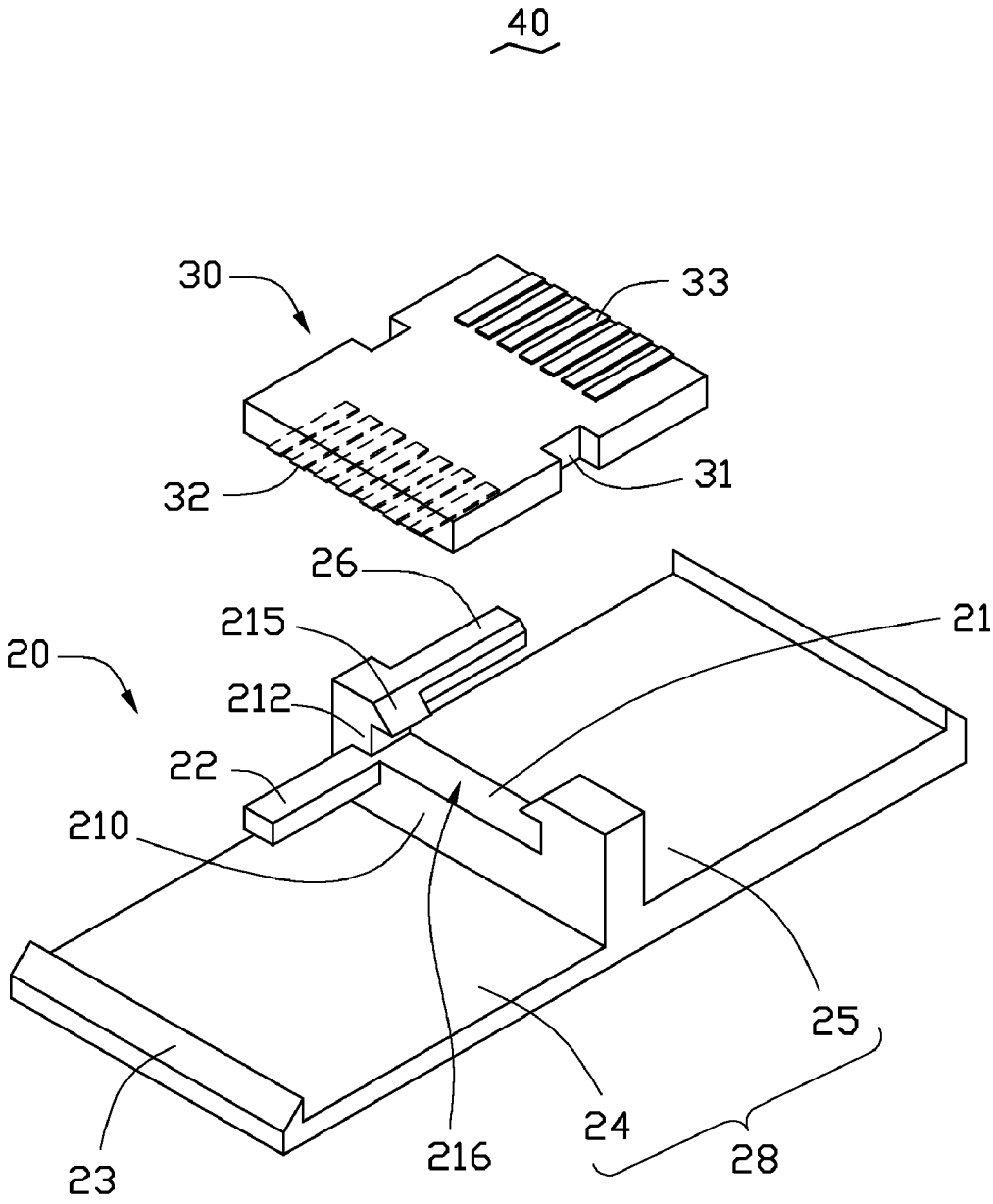
FIG. 1 is an exploded, isometric view of a first exemplary embodiment of an adapter apparatus.

Referring to FIG. 1, a first exemplary embodiment of an adapter apparatus 40 includes a receiving rack 20 and a connection board 30.

The receiving rack 20 includes a rectangular base 28, two substantially wedge-shaped blocks 23 extending up from opposite ends of the base 28, and a fastening plate 21 substantially perpendicularly extending up from a center of the base 28 and parallel to the blocks 23. The base 28 is divided into a first part 24 and a second part 25 each between the fastening plate 21 and a corresponding block 23. In this embodiment, the first part 24 has a different thickness than the second part 25.

The fastening plate 21 includes a first plate 210 substantially perpendicularly extending up from the center of the base 28, and two second plates 212 substantially perpendicularly extending up from opposite ends of a top surface of the first plate 210. An opening 216 is bound by the first plate 210 and the second plates 212. A first mistake-proof pole 22 and a second mistake-proof pole 26 opposite to each other respectively substantially perpendicularly extend from a top of the first plate 210 and a top of the second plate 212, at one of the ends of the fastening plate 21. A substantially wedge-shaped latch 215 extends from the top of each second plate 212 towards the other second plate 212. In this embodiment, the receiving rack 20 is integrally manufactured.

The connection board 30 is substantially rectangular, and includes a first side and a second side opposite to the first side. The connection board 30 defines two cutouts 31 in centers of the first and second sides. A plurality of first gold fingers 32 are formed on a first end of the connection board 30. A plurality of second gold fingers 33 are formed on a second end of the connection board 30 opposite to the first end. The first gold fingers 32 and the second gold fingers 33 are electrically connected to each other, and are arranged on opposite surfaces of the connection board 30.

Figure 2:
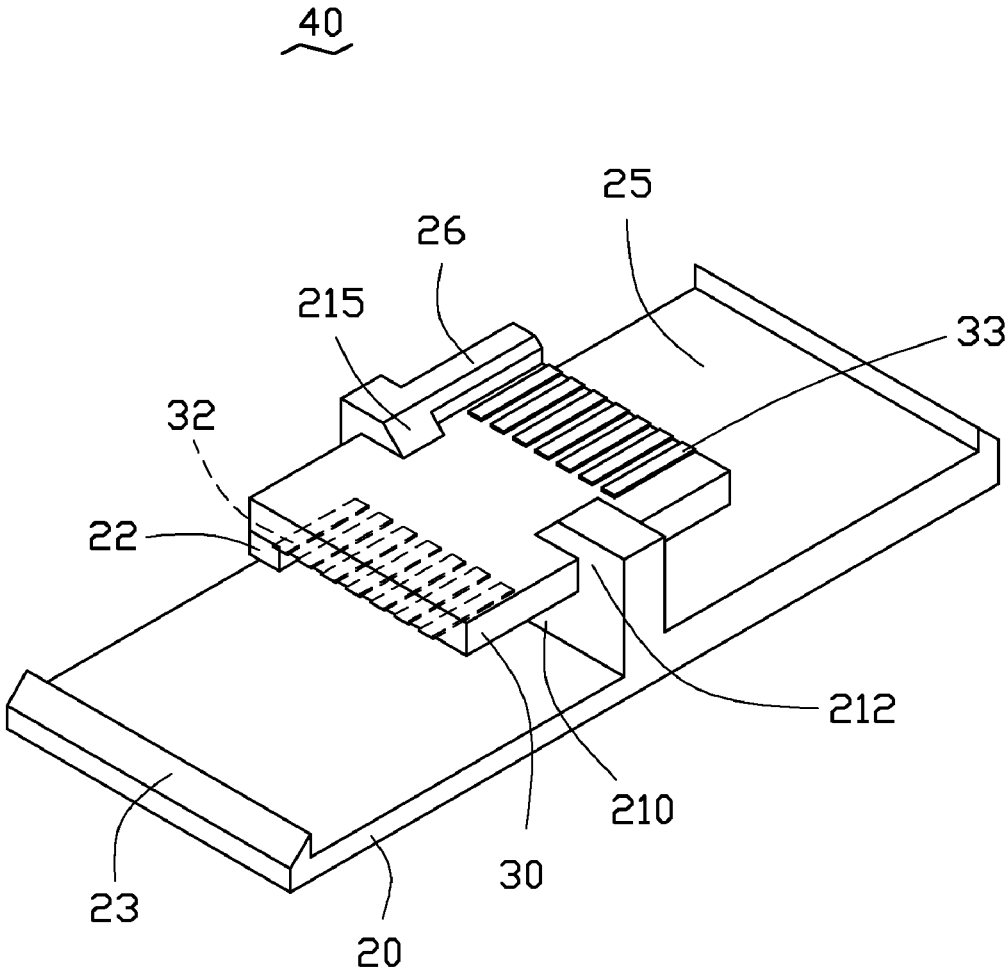
FIG. 2 is an assembled, isometric view of the adapter apparatus of FIG. 1.

Referring to FIG. 2, in assembly, the connection board 30 is attached to the receiving rack 20. One of the surfaces of the connection board 30 faces the base 28 of the receiving rack 20, and the other surface of the connection board 30 is opposite to the base 28. The connection board 30 is pushed to the base 28, the opposite sides of the connection board 30 respectively resist against the latches 215 of the second plates 212 to deform the second plates 212 out. After the connection board 30 enters the opening 216, the second plates 212 restore, thereby the latches 215 resist against the top surface of the connection board 30 at the cutouts 31, and the first plate 210 resists against the bottom surface of the connection board 30. The first and second mistake-proof poles 22 and 26 respectively resist against the bottom and top surfaces of the connection board 30.

Figure 3:
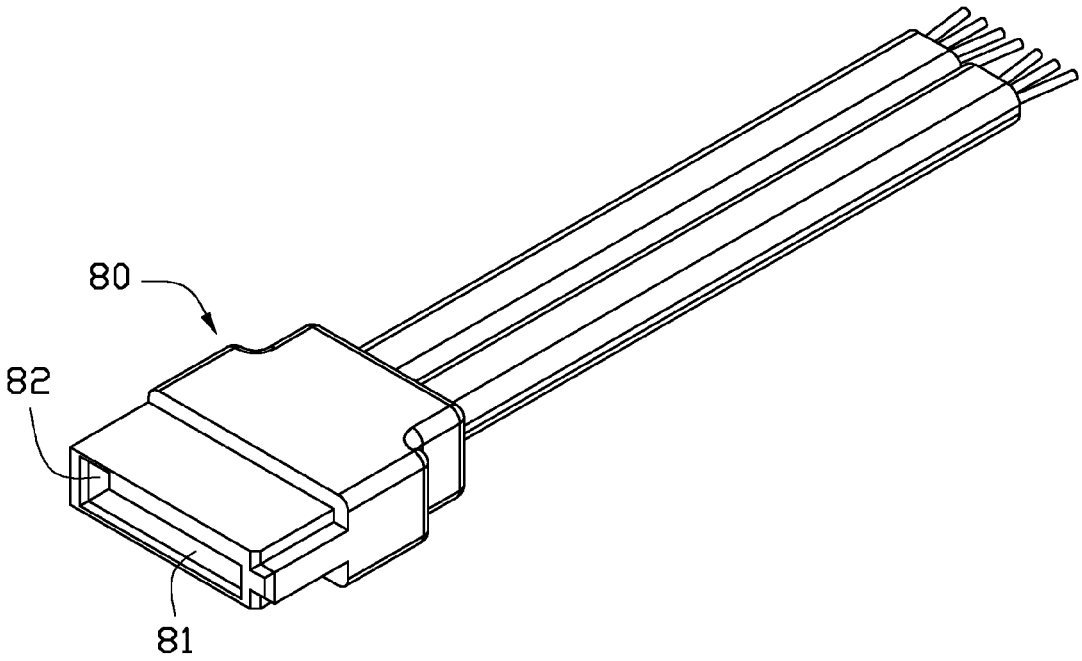
FIG. 3 is a schematic, isometric view of a serial advanced technology attachment (SATA) cable.
Figure 4:
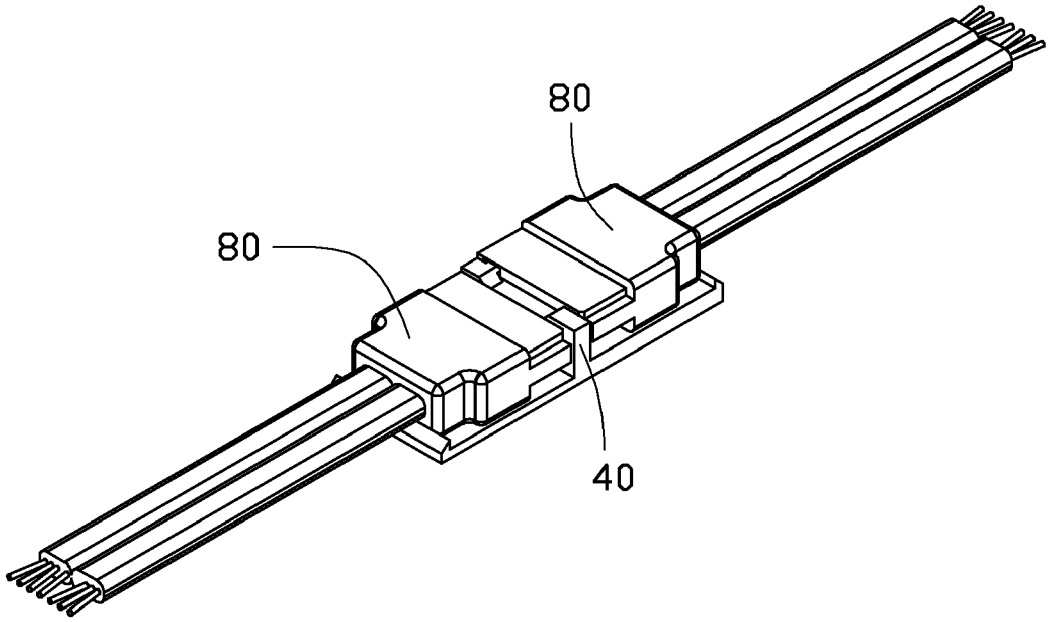
FIG. 4 shows the adapter apparatus of FIG. 2 being used to connect two of the SATA cables shown in FIG. 3.

Referring to FIGS. 3 and 4, in use, two SATA connectors 80 are respectively oriented to attach to the first part 24 and the second part 25, pressing against the corresponding blocks 23. Each SATA connector 80 defines a connection slot 81, and a mistake-proof slot 82 communicating with the connection slot 81. The first and second mistake-proof poles 22 and 26 are respectively received in the mistake-proof slots 82 of the corresponding connectors 80. The first and second gold fingers 32 and 33 are respectively electrically connected to the connection slots 81 of the corresponding connectors 80. Opposite ends of each SATA connector 80 respectively resist against the corresponding block 23 and the plate body 210, after the connector 80 is completely engaged with the corresponding first gold fingers 32 or the second gold fingers 33. Thus, the SATA connectors 80 are mounted to the receiving rack 20 and electrically connected to each other by the connection board 30. The first and second mistake-proof posts 22 and 26 prevent the SATA connectors 80 being connected in the wrong orientation. The thicknesses of first part 24 and the second part 25 are different, which makes it easier to properly orient each SATA connector 80 when plugging it in.

Figure 5:
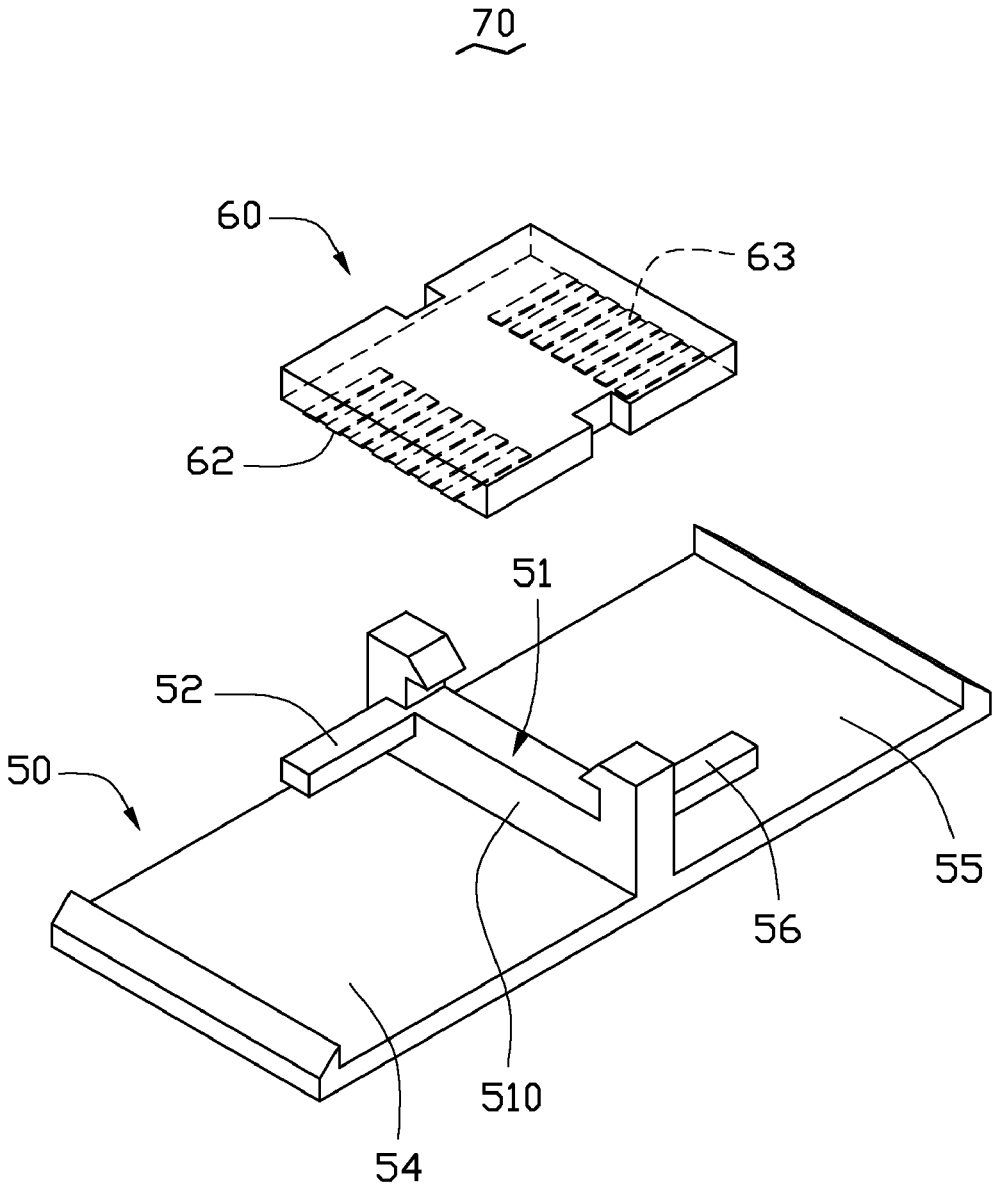
FIG. 5 is an exploded, isometric view of a second exemplary embodiment of an adapter apparatus.
Figure 6:
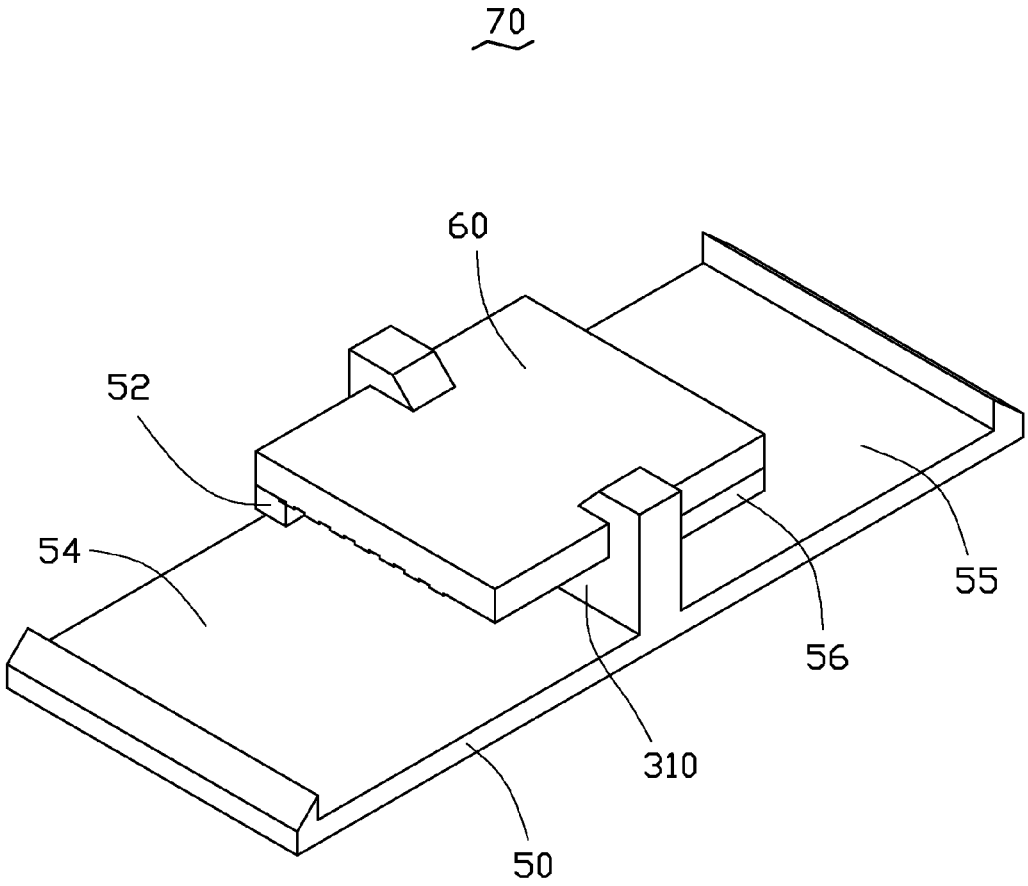
FIG. 6 is an assembled, isometric view of the adapter apparatus of FIG. 5.

Referring to FIGS. 5 and 6, a second exemplary embodiment of an adapter apparatus 70 includes a receiving rack 50 and a connection board 60.

The receiving rack 50 is substantially to the same as the receiving rack 20 of the first exemplary embodiment of the adapter apparatus 40, except that a first part 54 has the same thickness as a second part 55, and a first mistake-proof pole 52 and a second mistake-proof pole 56 perpendicularly extend from tops of opposite ends of a first plate 310 of a fastening plate 51. The first and second mistake-proof poles 52 and 56 extend away from each other.

The connection board 60 is that same as the connection board 30, except that first and second gold fingers 62 and 63 are arranged on a same surface of the board 60 so that the same orientation is used for each SATA connector 80 when plugging it in.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

The invention claimed is:

1. An adapter apparatus for connecting two connectors of the same type, the adapter apparatus comprising:

a receiving rack to fix the connectors; and a connection board mounted to the receiving rack, the connection board comprising a plurality of first gold fingers, and a plurality of second gold fingers electrically connected to the plurality of first gold fingers, wherein the plurality of first and second gold fingers are arranged on opposite ends of the connection board, to be directly electrically connected to the connectors, respectively;

wherein the receiving rack comprises a substantially rectangular base, and a fastening plate perpendicularly extending up from a center of the base to divide the base into a first part and a second part, the connection board is fixed on the fastening plate; and wherein two substantially wedge-shaped blocks extend up from opposite ends of the base, opposite ends of each connector are blocked by a corresponding one of the wedge-shaped blocks and the fastening plate.

2. The adapter apparatus of claim 1, wherein the fastening plate comprises a first plate substantially perpendicularly extending up from the center of the base, and two second plates extending up from opposite ends of a top of the first plate, an opening, through which the connection board extends, is bound by the first plate and the second plates, a latch extends from the top of each second plate towards the other second plate, to resist against opposite sides of the connection board.

3. The adapter apparatus of claim 2, wherein the connection board defines two cutouts in centers of the opposite sides, respectively, corresponding to the second plates of the receiving rack.

4. The adapter apparatus of claim 2, wherein a first mistake-proof pole and a second mistake-proof pole substantially perpendicularly extend from a top of the first plate and a top side of the second plate at the same end of the fastening plate, away from each other.

5. The adapter apparatus of claim 4, wherein the first gold fingers and second gold fingers are respectively arranged on opposite surfaces of the connection board.

6. The adapter apparatus of claim 5, wherein the first part and the second part have different thicknesses.

7. The adapter apparatus of claim 2, wherein a first mistake-proof pole and a second mistake-proof pole substantially perpendicularly extend from opposite ends of a top of the first plate, away from each other.

8. The adapter apparatus of claim 7, wherein the first gold fingers and second gold fingers are arranged on a same surface of the connection board.

9. The adapter apparatus of claim 8, wherein the first part and the second part have the same thickness.

* * * * *